United States Patent [19]

Evans

[11] 4,440,239

[45] Apr. 3, 1984

[54] METHOD AND APPARATUS FOR CONTROLLING THE FLOW OF DRILLING FLUID IN A WELLBORE

[75] Inventor: John L. Evans, Houston, Tex.

[73] Assignee: Exxon Production Research Co., Houston, Tex.

[21] Appl. No.: 306,252

[22] Filed: Sep. 28, 1981

[51] Int. Cl.[3] ..... E21B 47/10

[52] U.S. Cl. ..... 175/5; 175/38; 73/155; 364/510

[58] Field of Search ..... 175/5, 7, 48, 24, 38, 175/65, 66; 73/155; 364/424, 510

[56] References Cited

U.S. PATENT DOCUMENTS

| | | | |
|---|---|---|---|
| 3,602,322 | 8/1971 | Gorsuch | 175/48 |
| 3,760,891 | 9/1973 | Gadbois | 175/48 |
| 3,815,673 | 6/1974 | Bruce et al. | 175/7 |
| 3,910,110 | 10/1975 | Jefferies et al. | 175/48 |
| 3,976,148 | 8/1976 | Maus et al. | 175/7 |
| 4,253,530 | 3/1981 | Sharki et al. | 175/48 |
| 4,282,939 | 8/1981 | Maus et al. | 175/7 |
| 4,295,366 | 10/1981 | Gibson et al. | 175/48 |

*Primary Examiner*—Stephen J. Novosad
*Assistant Examiner*—William P. Neuder
*Attorney, Agent, or Firm*—Kenneth C. Johnson

[57] ABSTRACT

A method for controlling the flow of drilling fluid through a subaqueous wellbore is disclosed. The method comprises the steps of continuously measuring the output flow rate (A) of the drilling fluid from the wellbore, the input flow rate (B) of the drilling fluid to the wellbore, and at least a component of the pitch and roll (P/R) of the vessel, computating a floating alarm limit (C) dependent upon the pitch and roll (P/R) signal and the roughness of the sea, filtering the periodic fluctuation of the output flow rate (A) due to the motion of the vessel, and computating the delta flow signal (D) by subtracting the input flow rate (B) from the filtered output flow rate (A). The method further comprises the step of generating a signal whenever the absolute value of the delta flow rate (D) exceeds the floating alarm limit (C) to provide a visible warning that the flow of drilling fluid is out of control and to either close off the wellbore in case of a kick or to stop the flow of fluid and stop drilling in case of lost returns.

Apparatus for controlling the flow of drilling fluid through a subaqueous wellbore is disclosed while drilling from a floating vessel. The wellbore is connected to the lower end of the drill string and the lower end of an annulus by a valve through which the drilling fluid flows. The upper end of the annulus is connected to a conduit from which the drilling flows to the suction side of a pump which circulates the drilling fluid therefrom into the upper end of the drill string, through the wellbore, and back up the annulus into the conduit. The apparation comprises an output flow meter connected to the exit of the conduit, an input flow meter connected between the pump and the upper end of the drill string, means mounted on the vessel for sensing the pitch and roll of the vessel, and computer means for receiving the output flow rate (A) signal from the output flow meter, the input flow rate (B) from the input flow meter, and the pitch and roll (P/R) signal from the pitch and roll sensing means. The computer means calculates an alarm limit (C) based on the pitch and roll (P/R) signal and the roughness of the sea continuously filters the periodic fluctuation of the output flow rate (A) due to the motion of the vessel, computes the delta flow signal (D) by subtracting the input flow rate (B) from the filtered output flow rate (A), and generates a signal whenever the delta flow rate (D) exceeds the floating alarm limit (C) to provide a warning of a possible blowout or lost circulation condition and to either close off the wellbore in case of a kick or to stop the flow of fluid and stop drilling in case of lost returns.

43 Claims, 11 Drawing Figures

READ
N & Ts
P=0
75
t = Ts /N
SAMPLE RATE
76
72
READ
A
EVERY "t"
SECONDS
77
CONVERT A
TO DIG. SIG.
78
80
IS
P≧N
?
79
P=0
N
84a
85a
P=P+1
81
RAM
A(N)
A(N-1)
A(1)
83
A(P)=A
WRITE
A(P)
82
84
$A_s = \sum_{n=1}^{N} A_n / N$
85
$A_r = \frac{\sum_{n=1}^{N} |A_n - A_s|}{N}$ 86
104
IS J = 1 TREND ANAL. LOOP ACTIVE ?
105
IS Df > C ?
Y
J = 1 ACTIVATE TREND ANAL.
106
E
Tm = CLOCK
107
IS Tm - Tn > T2 ?
Tn = Tm
108
IS L ≥ M MIN # OF SAMPLES ?
112
IS Df > C ?
L = 0
113
111
RAM Dx(M) Dx(M-1) Dx(1)
109
L = L + 1
D(L) = Df WRITE D(L)
110
Dt = Σ Dx(m) / M
114

METHOD AND APPARATUS FOR CONTROLLING THE FLOW OF DRILLING FLUID IN A WELLBORE

FIELD OF THE INVENTION

This invention relates to a method and apparatus for controlling the flow of drilling fluid through a subaqueous wellbore and, more particularly, to a method and apparatus for identifying the introduction of high pressure fluid into the bore from adjacent earth formations and the loss of drilling fluid from the bore into adjacent earth cavities during a drilling operation being conducted from a floating vessel subject to all six degrees of motion.

BACKGROUND OF THE INVENTION

In an offshore drilling operation, a vessel indicated generally at 20 in FIG. 1 supports a derrick 21 at sea 22. A hollow drill string 23 suspended from the derrick 21 by a swivel connector 24, extends downwardly therefrom through a slip joint 25 and a marine riser 26 and terminates at a drill bit 27 within a wellbore 28 in the sea floor 29. The slip joint 25 comprises upper and lower cylinders 30 and 31, respectively. One end of the riser 26 is attached to a wellhead 32 embedded in the sea floor 29 and is connected to the well 28 with a typical blowout preventive (BOP) valve 33 well known in the art; the other end of the marine riser 26 is connected to the lower cylinder 31 of the slip joint 25. Riser-tensioning apparatus 34 and 35, which is also well known in the art, is attached to the upper end of the lower cylinder 31 and provides upward force necessary to support the riser 26. The upper and lower cylinders 31 and 30, respectively, of the slip joint 25 telescope to compensate for the heave of the vessel 20, i.e., motion along the z-axis caused by wave, tide, and current influences. The upper cylinder 30 strokes inside the lower cylinder 31 which remains stationery with respect to the sea floor 29 as the vessel 20 oscillates. The outer surface of the drill string 23 and the inner surfaces of the slip joint 25 and the riser 26 define the annulus 36. A conduit 37 intersects the upper portion of the upper cylinder 30 of the slip joint 25 and extends to a shale shaker 38 and active mud tanks 39. A pump 40 is connected between a standpipe 41 and the active tanks 39 from which it takes suction. The standpipe 41 is connected to a flexible hose 42 which in turn connects to the swivel connector 24 within the derrick 21.

To drill the well 28 using rotary drilling methods, drilling fluid (hereinafter referred to as "mud") is circulated by the pump 40 into the swivel 24 and through the drill string 23 to the orifices in the drill bit 27. The mud then circulates from the drill bit 27 upwardly through the annulus 36 and the conduit 37 into the shale shaker 38 where it is processed, e.g., drill cuttings removed, chemicals added, etc., and then returned to the active tanks 39 for recirculation by the pump 40. In a drilling operation, the mud has several functions, the most important being to restrain high pressure fluids 43 within various earth formations. Occasionally, the high pressure fluid 43 intrudes into the well 28 and displaces the mud. This initial intrusion is referred to as a kick. If this occurs, it is important that the pressure condition be balanced as soon as possible; otherwise, the high pressure fluid might flow up the annulus 36. This condition is known as a blowout. However, if during the drilling operation, a weak earth formation 44, is encountered, the hydrostatic pressure of the mud may fracture the rock and the mud may disburse freely into the formation 44 from the well 28. This initial fluid loss is referred to as lost returns. The condition is known as lost circulation. If the loss of mud from the annulus 36 into the formation 44 reduced the hydrostatic pressure below that of the high-pressure fluids 43, the lost circulation condition might even initiate a blowout condition.

A blowout is most effectively prevented when the kick or initial intrusion of the formation fluid is quickly detected and limited before it displaces a significant amount of mud from the well 28. Similarly, lost circulation is most effectively limited when the intiation of the loss can be quickly detected and counteracted before a significant amount of mud has flowed from the well 28 into the formation 44. Time is of the essence when trying to control these abnormal drilling conditions which may become dangerous situations. One method commonly used in the drilling industry to detect kicks or lost circulation is based on a determination of the flow of mud from the well. In this method, the output flow rate, A, i.e., the rate of flow of drilling mud returning from the well, is compared with either (i) earlier output flow rates or (ii) the input flow rate, B, i.e., the rate of mud circulating into the well. Although the former approach is commonly used, the latter approach has the advantage of compensating automatically for normal changes in the mud circulating rate by subtracting the input flow rate (B) from the output flow rate (A) to yield what is commonly referred to as the delta flow rate, D. If the sea 22 is calm, a positive delta flow rate, +D, would correspond to an equivalent increase in the output flow rate (A) and thus indicate a flow of fluid into the well 28 or a kick. Similarly, a negative delta flow rate, −D, would correspond a decrease in the return flow rate and thus indicate a flow of fluid out of the well 28 or a lost circulation.

Unfortunately, drilling offshore wells from a floating vessel complicates the monitoring of the return mud rate at sea, the heaving motion of the vessel 20 as described above, increases and decreases the output flow rate, A, which makes it impractical to measure the delta flow rate. Th maximum and minimum flow rate of the mud induced by the extension and contraction of the slip joint 25 may be several times larger or smaller than the actual or true output flow rate from the well 28. For example, variations may occur in the measured output flow rate from mud from zero gallons per minute (GPM), when the slip joint 25 is expanding, to about 1,500 GPM in the normal direction, when the slip joint 25 is contracting, compared to a true output flow rate of mud from the well 28 of about 800 GPM. The rapid determination of a blowout or lost circulation condition is impossible without a means to correct for the effects of the heave of the vessel 20 if one wishes to monitor the delta flow rate (D).

U.S. Pat. No. 3,602,322 granted August, 1971, to D. C. Gorsuch discloses a delta-flow system for determining a blowout or lost circulation on land rigs. However, its application is limited to a motionless environment because the Gorsuch system cannot effectively deal with variations in the output flow rate of mud resulting from the heaving motion of the vessel 20. Subsequent patents disclose inventions attempting to solve the heave problems by focusing on the slip joint 25 which induced time varying changes in the output flow rate (A) as discussed above. For example, U.S. Pat. No.

3,910,110 granted October, 1975, to R. K. Jeffries, et al., discloses a delta-flow system for detecting a kick or lost circulation in a subsequent well in which the output flow rate of the mud is modified by adding a coefficient corresponding to the measured volume change in the slip joint 25. U.S. Pat. No. 3,976,148 granted August, 1976, to L. D. Maus, et al., discloses a delta flow system which does not require a direct measurement of the change in volume of the slip joint 25, but rather a measurement of the fluid volume in a tightly coupled surge tank. Each of these patents have serious disadvantages such as complicated mechanical and plumbing requirements associated with the marine riser 26. Additionally, each of these patents totally disregards the other five motions of the vessel, i.e., surge, sway, roll, pitch, and yaw, all of which introduce variations in the output flow rate (A).

SUMMARY OF THE INVENTION

The present invention comprises a method and apparatus for controlling the flow of drilling fluid through a subaqueous wellbore. The method with the aid of computer means comprises the steps of continuously measuring the output flow rate (A) of the drilling fluid from the wellbore, the input flow rate (B) of the drilling fluid to the wellbore, and at least a component of the pitch and roll (P/R) of the vessel, filtering the periodic fluctuation of the output flow rate (A) which is due to the motion of the vessel, and computing the delta flow signal (D) by subtracting the input flow rate (B) from the filtered output flow rate (A). The method further comprises the step of generating a signal whenever the delta flow rate (D) exceeds a floating alarm limit (C) to provide a visual warning that the flow of drilling fluid is out of control and to either close off the BOP valve 33 in case of a kick or throttle back the pump 40 and stop drilling in case of lost returns. Attenuating the periodic fluctuation of the output flow rate (A) permits detection of the steady state changes in the delta flow signal (D) without the use of mechanical contrivances as suggested by the abovementioned patents. The invention recognizes that it is possible to monitor the motion of the vessel and adjust the filters according to the dominant periodic motion of the vessel. Additionally, the invention recognizes that the floating alarm level (C) can be adjusted to compensate for the anticipated roughness of different sea states as well as for the other motions of the vessel. The apparatus comprises an output flow meter connected to the conduit 37, an input flow meter connected to the flexible hose 42, means mounted on the derrick 21 for sensing the pitch and roll of the vessel 20, and computer means for receiving signals (A, B, and P/R) from the output and input flow meters and the pitch and roll sensing means respectively. The computer means evaluates the delta flow signal (D) to determine whether a blowout or lost circulation conditions exists and then transmits a signal to give a visual indication thereof and to either close the BOP valve 33 in the case of a kick or throttle back the pump 40 and stop drilling in the case of lost returns.

DETAILED DESCRIPTION OF THE INVENTION

Figure 1:
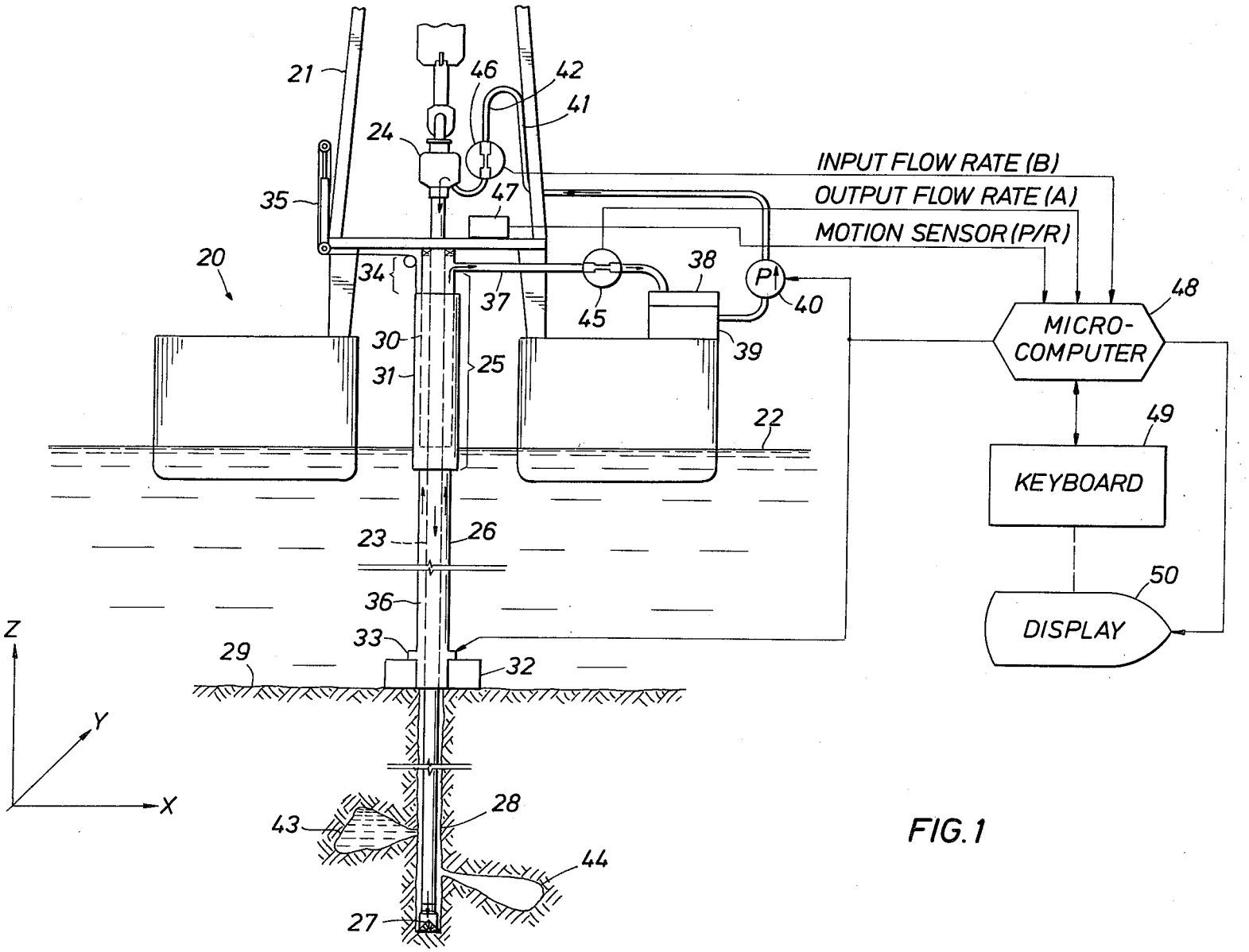
FIG. 1 is a partially schematic elevation view of an offshore floating vessel drilling a subaqueous wellbore and a block diagram schematically illustrating the invention for controlling the flow of drilling fluid through the subaqueous wellbore.

Referring again to FIG. 1, the apparatus comprises an output flow meter 45 connected to the conduit 37, an input flow meter 46 connected to the flexible hose 42, means 47 mounted on the derrick 21 for sensing at least a component of the pitch and roll of the vessel 20, a microcomputer 48 for receiving signals from the output and input flow meters 45 and 46, respectively, and the sensing means 47, a keyboard 49 communicably associated with the microprocessor 48, and a video display 50 responsive to the microcomputer 48. The flow meters 45 and 46 are magnetic flow meters which can be, for example, Model 10D1435A/U manufactured by Fischer and Porter. The operation of a magnetic flow meter is based on the voltage induced by the flow of mud, a conducting fluid, past a strong magnetic field. Although the magnetic flow meter is preferred because it has no moving parts and does not require the insertion of any parts into the flow, other flow meters can be used such as, for example, turbine flow meters, sonic flow meters, etc. The sensing means 47 comprises a pair of linear accelerometers mounted on an x-y plane of the derrick 21 to sense acceleration in the "x" and "y" directions. The linear accelerometer aligned to sense motion along the x-axis measures both the surge and the x-component of pitch of the vessel 20; the other accelerometer aligned to sense motion along the y-axis measures the sway and the y-component of roll of the vessel 20. The linear accelerometers 47 are aligned to sense translational motion to approximate the pitch and roll motion of the vessel 20. The linear accelerometers used can be, for example, type M114 manufactured by Setra Systems. The microcomputer 48 can be, for example, the System 80/20 or the System 80/10 manufactured by the Intel Corporation. Both flow meters 45 and 46 and the linear accelerometers 47 are connected directly to either the 80/20 System or the 80/10 System at the SBC 711 along input board thereof. Load resistors should be used on these inputs to help reduce the noise and, in the case of the flow meters 45 and 46, to convert the 4–20 mA signal to a 10 volt peak signal. The keyboard 49 and the video display 50 are typically one unit such as, for example, the DEC scope VT 100 Terminal manufactured by the Digital Equipment Corporation. This terminal 49 and 50 is connected directly to either the 80/20 or the 80/10 System at the RS 232 interface thereof. The terminal 49 and 50 allows the drilling operator to input various constants into the microcomputer 48 and will project a warning on the display when a blowout or lost return condition occurs. An audio alarm (not shown) can also be used to warn the drilling operator.

When a blowout or lost returns condition does exist, the microcomputer 48 gives the drilling operator a warning on the display 50. If a blowout condition occurs, the microcomputer 48 also causes the pump 40 to shut down and the BOP valve 33 to close off the wellbore 28. The BOP valve 33 can be one of several types such as, for example, a ram type valve in which two metal blocks are hydraulically actuated to close off the wellbore 28 or a spherical type valve in which a rubber torus reinforced with steel is hydraulically squeezed to close off the wellbore 28. The BOP valve 33 is connected to a hydraulic line (not shown) and actuated when a valve (not shown) connects a pressure source (not shown) to the hydraulic line. When the microcomputer 48 senses the blowout condition, the output signal therefrom actuates a relay (not shown) which causes a solenoid (not shown) to be energized. The solenoid is operatively associated with the pressure-source valve and opens that valve upon being energized to actuate the BOP valve 33. At this point, the well 28 is closed off and in a safe condition because the influx of high-pressure fluid 43 has been arrested. The drilling operator may then proceed with a standard kick procedure which is well known in the drilling technology.

If, however, a lost circulation condition occurs, the microcomputer 48 causes the pump to throttle back to an idle speed and then disables rotation of the drill string 23. When the microcomputer 48 senses the lost circulation condition, the output signal therefrom actuates a relay (not shown) which causes a solenoid (not shown) to be energized. The solenoid is operatively associated with the throttle of the pump 40 which slows down to its idle speed when the solenoid is energized. At this point, the well 28 is as safe as possible and the drilling operator can proceed with a standard lost returns procedure well known in the drilling art. Therefore, it is to be understood, that whenever a blow out or lost returns warning is given to the drilling operator, the microcomputer 48 simultaneously causes the drilling equipment to be operated in such a way, depending on whether a kick or lost returns is sensed, as to make the well safe.

As mentioned above, the microcomputer 48 receives the output flow rate (A) from the output flow meter 45 and the input flow rate (B) from the input flow meter 46, whereupon the delta flow rate (D) is calculated. If the sea 22 were always calm, a positive delta flow rate (D) would indicate a kick whereas a negative delta flow rate (D) would indicate a lost circulation as discussed above. However, since the motion of the vessel 20 increases and decreases the output flow rate (A) significantly, as the example above indicates, the invention contemplates filtering the output flow rate (A) to attenuate the dominant periodic motion therefrom so that the resulting filtered output substantially represents the steady state or true output flow rate from the wellbore 28. It is to be understood that the input flow rate (B) can also be filtered, but is not necessarily required since it remains substantially constant unless deliberately altered by the drilling operator. It is also to be understood that the output flow rate (A) can be filtered by filtering the delta flow rate (D) itself. To accomplish the filtering, a low-pass filter is used and adjusted to a cutoff frequency wherein the period ($\tau$) is from about two to four times greater than the dominant period of the waves. For example, waves having a 15 second period require a filter having a cutoff frequency ranging from about 0.0333 to about 0.0167 Hz. based on a time constant ranging from a fast 30-second value, $\tau_f$, to a slow 60-second value, $\tau_s$.

Filtering the output flow rate (A) at the proper cutoff frequency or frequencies, attenuates the dominant periodic component of fluctuation induced not only by the heave component of vessel motion, but also the other five vessel motions including pitch and roll. Regardless of whether the filter used has a fast time constant ($\tau_f$) or a slow time constant $\tau_s$), residual fluctuation, or noise, is present in the delta flow rate (D) as illustrated by the fast and slow delta flow rate, $D_f$ and $D_s$ respectively, in FIGS. 2 and 3, respectively. Both graphs are representative of outputs recorded while experimenting with the invention. Although the slow filter attenuates fluctuation more severely than does the fast filter, time is of the essence when trying to warn the drilling operator of a possible blowout or lost returns condition. Therefore, the fast filter having the smallest time constant ($\tau_f$) is preferable. In this case, the lag factor ($\tau_f/2$) associated with the fast filter is approximately 15 seconds, which means that the fast delta flow rate ($D_f$) might take up to 15 seconds to respond to a kick before warning the drilling operator. This is graphically represented by the line 51 which corresponds to the average value of the fast delta flow rates ($D_f$) that increase in response to a kick graphically represented by a ramp function as shown along a dashed line 52. However, even though the fast filter responds more rapidly than does the slow filter, it is more sensitive and consequently permits a larger residual fluctuation in the filtered output flow rate. As such, the larger residual fluctuation is still evident in the fast delta flow rate ($D_f$) which fluctuates through a range of approximately ±40 GPM. Therefore, an alarm limit, C, is set slightly larger than the maximum residual fluctuation of the fast delta flow rate ($D_f$), ±50 GPM in this case, to decrease the frequency of false alarms. The absolute value of the fast delta flow rate ($D_f$) is then continuously compared to the alarm limit (C). Whenever the absolute value breaches or exceeds the alarm unit (C), the drilling operator is warned of a possible blowout or lost returns condition depending on the sign of the fast delta flow rate ($D_f$).

Figure 4:
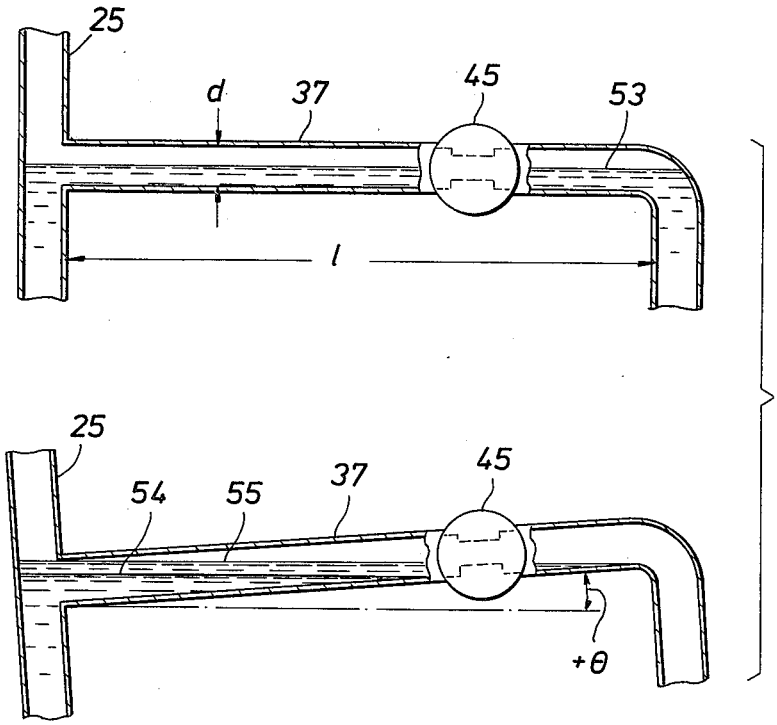
FIG. 4 is a partially schematic, vertical crossectional view of a conduit and an output flow meter in two positions as determined by the pitch or roll of the offshore floating vessel on which they are mounted.

One reason that the output flow rate fluctuates through such a large range is because of the effect of the pitch and roll motion on the conduit 37 as shown in FIG. 4. The conduit 37, which is connected between the upper cylinder of the slip joint 25 to the output flow meter 45, is typically a long, horizontal run and substantially oversized to accommodate chunks of gumbo or clay in the mud as it flows through the conduit 37. Therefore, when the conduit 37 is in the horizontal position, the level of mud is very low as indicated by the level at 53. However, when the vessel 20 rolls or pitches ($\theta$), the conduit 37 tilts and either increases or decreases the flow of mud through the output flow meter 45. If the end of the conduit 37 moves upwardly, no mud will exit through the flow meter 45, as indicated by the level of mud at 54, until the mud fills the conduit 37 to the level at 55. On the other hand, if the end of the conduit 37 moves downwardly (not shown), the mud will surge through the flow meter 45. Very small angles of rotation ($\theta$) produce very severe variations in the output flow rate (A) through the output flow meter 45. For example, a conduit 37 having a 12 inch diameter (d) and a horizontal run (1) totalling 80 feet has a storage capacity of approximately 235 gallons. The roll or pitch angle necessary to store this quantity is less than one degree ($\theta$=arc sin d/1). It is to be understood that the conduit 37 is but one example of the different flow lines that run between the upper cylinder of the slip joint 25 and the output flow meter 45.

Figure 5:
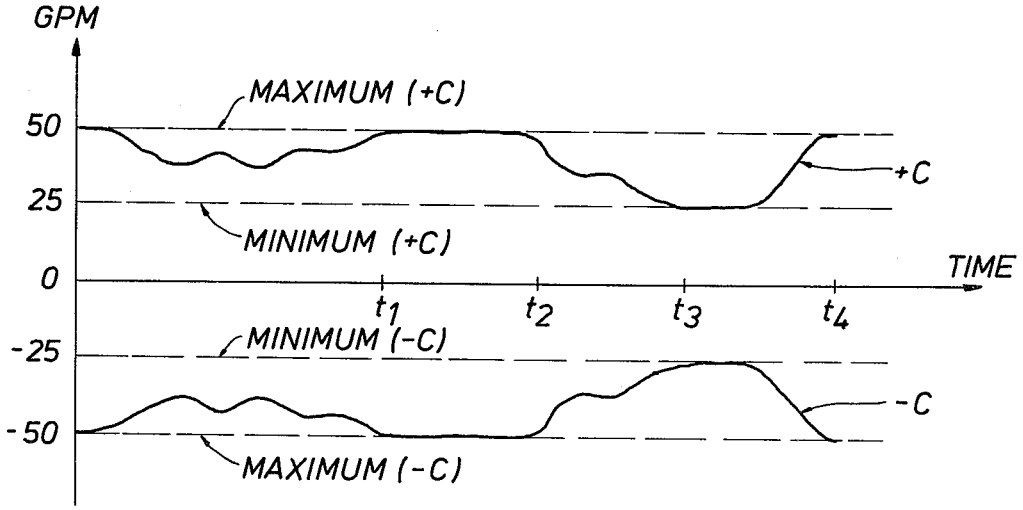
FIG. 5 is a graph illustrating the floating alarm limit (C) as a function of time in accordance with the invention.

Therefore, to further compensate for residual fluctuation in the output flow rate (A), the alarm limit (C) is essentially transformed into a "floating" limit, as illustrated in FIG. 5, dependent upon the pitch and roll of the vessel 20 and the roughness of the sea 22. When the microcomputer 48 reads an analog pitch and roll signal (P/R) greater than a specified limit (PR/LIM) corresponding to one degree of rotation, the "floating" alarm limit (C) is set to its maximum value of ±50 GPM as shown between times $t_1$ and $t_2$. However, if the pitch and roll signal (P/R) does not exceed the limit (PR/LIM), the floating alarm limit (C) is decreased proportionally with respect to the roughness of the sea. A roughness output ($A_r$) based on the output flow rate (A) is scaled to vary from the maximum limit of ±50 GPM at time $t_2$ when the sea is roughest to a minimum limit of ±25 GPM at time $t_3$ when the sea is smooth. The net effect of this computation is to reduce the number of false alarms to the drilling operator due to the pitch and roll of the vessel 20, while at the same time making the system more sensitive to a blowout or lost returns condition as the roughness of the sea becomes less severe as shown between times $t_2$ and $t_4$. The floating alarm limit (C), nonetheless, will be referred to hereinafter as a constant value for convenience, except when discussing the program in the microcomputer 48. The roughness output ($A_r$) will be discussed in more detail below.

As discussed above, the drilling operator will be warned of a possible blowout or lost returns condition whenever the absolute value of the fast delta flow rate ($D_f$) exceeds the alarm limit (C). However, the drilling operator must be certain that each breach of the alarm limit (C) identifies an actual blowout or lost returns condition and is not the result of residual fluctuation not eliminated by the filter. Two techniques can be used to minimize the number of false alarms. Referring back to FIG. 2, the first technique involves performing a trend analysis of the fast delta flow rate ($D_f$) after a "possible" alarm is registered at time $t_1$ when the absolute value of the fast delta flow rate ($D_f$) exceeds the alarm limit (C). The trend analysis samples a predetermined number (M) of delta flow rates ($D_f$) and computes a delta trend value ($D_t$), each time a new delta flow rate ($D_f$) is sampled, by summing all the most recently sampled delta flow rates ($D_f$) and dividing by M. This trend analysis, which will be described in more detail hereinbelow, is illustrated dotted lines 56 and 57, each of which corresponds to a locus of delta trend values, $D_{t1}$ and $D_{t2}$, respectively. If the trend analysis at 56 does not breach the alarm limit (C) after a predetermined amount of time at time $t_2$, the possible alarm is "rejected." If, however, a second "possible" alarm registers at time $t_3$ and the trend analysis at 57 does exceed the alarm limit (C), the possible alarm is "confirmed" and the drilling operation is warned.

The second technique is to use a modified version of the slow filter in a parallel configuration with the fast filter. To increase the responsiveness of the slow filter, the slow delta flow rate ($D_s$) is multiplied by a sensitivity factor, S, ranging from about 1.5to 3.0, which in this case reduces the lag time from 30 seconds ($\tau_s/2$), as indicated by the dashed line 58 and line 59, to approximately 15 seconds, as indicated by the dashed line 58 and dotted dashed line 60, without signficantly increasing the amplitude of the slow delta flow rate ($D_s$). The effect is to eliminate the noise that can cause a false alarm without sacrificing the sensitivity required to identify a blow out or lost returns condition. Thus, experimental results indicated that when the fast delta flow rate ($D_f$) registered a "false" alarm at time $t_1$, the modified slow delta flow rate ($SD_s$) did not breach the alarm limit (C); however, shortly after the fast delta flow rate ($D_f$) registered a second "possible" alarm at time $t_3$, the modified slow delta flow rate ($SD_s$) did breach the alarm limit (C) to give the drilling operator a warning at time $t_5$ which was about the same time the trend analysis "confirmed" the second possible alarm registered by the fast delta flow rate ($D_f$). These two techniques can be used alternatively or conjunctively with the fast delta flow rate ($D_f$); the preferred embodiment is to use both.

Figure 6:
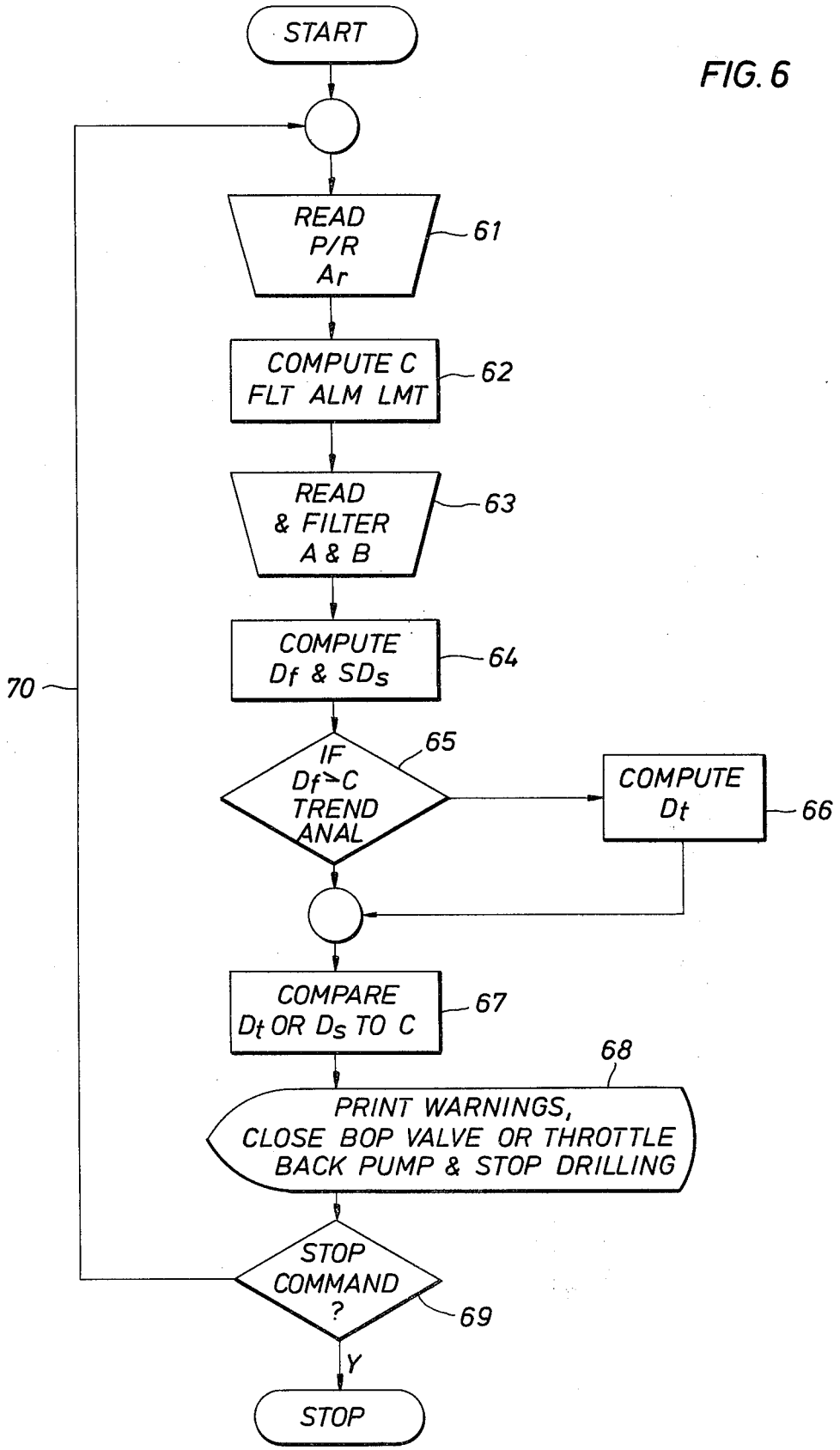
FIG. 6 is an overview flowchart of a program which manipulates the inputs from the sensors to control the flow of drilling fluid through the subaqueous wellbore according to the invention.

Referring now to FIG. 6, an overview flowchart of the program stored in the microcomputer 48 is shown. When this program is implemented by the microcomputer 48, the latter is transformed into a control device which causes the BOP valve 33 (FIG. 1) to block the flow of mud to and from the wellbore 28 when a blowout condition exists or throttle back the pump 40 and stop drilling in the case of a lost returns condition as described hereinabove. After the program has started (FIG. 6), it reads the pitch and roll signal (P/R) and the roughness output ($A_r$) at 61 to compute the floating alarm limit (C) at 62. The program then reads and filters the output and input flow rates (A and B) at 63 to compute the delta flow rates ($D_f$, $SD_s$) at 64. If the fast delta flow rate ($D_f$) breaches the floating alarm limit (C), the program determines that a trend analysis should be performed at 65 and computes a delta flow trend ($D_t$) at 66. Even if the fast delta flow rate ($D_f$) does not breach the floating limit (C), the program compares the greater of the slow delta flow rate ($D_s$) or the most recently calculated delta flow trend ($D_t$) to the floating alarm limit (C) at 67. If either breaches the floating alarm limit (C), the drilling operator receives warning on the video display 50 and the BOP valve 33 is closed as indicated at 68. If the drilling operator does not then give a command through the keyboard 49 to stop the program as indicated at 69, the program returns to read another pitch and roll signal (P/R) and roughness output ($A_r$) at 61 as indicated by the line 70. As mentioned above, this flow chart represents an overview of the more detailed logic flowcharts explaining the program in FIGS. 9, 10, and 11.

Figure 7:
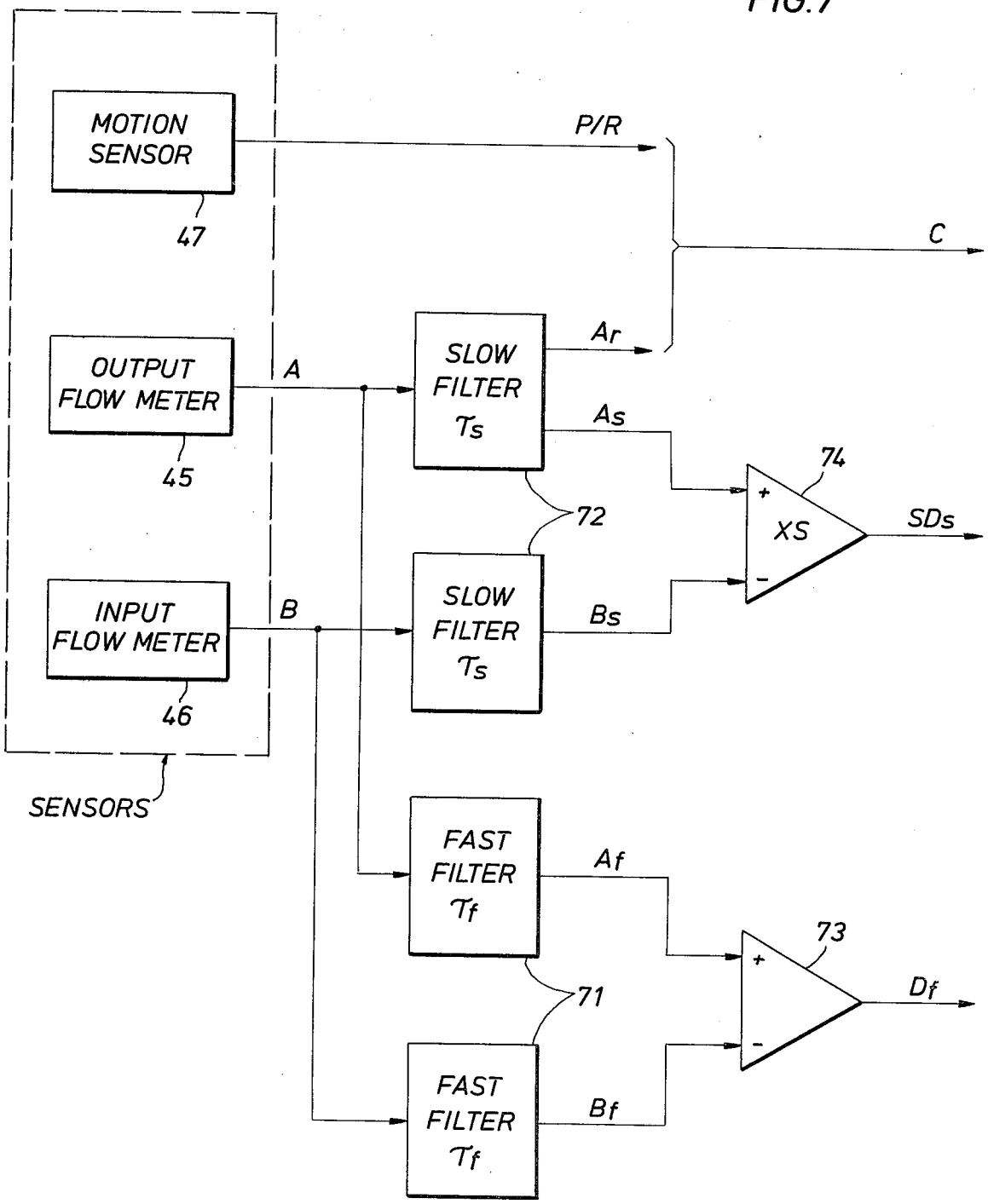
FIG. 7 is a block diagram of the input sensors, the filters, and delta flow rate computations in accordance with the invention.

Referring in more detail to FIG. 7, both the output flow rate (A) and the input flow rate (B) are filtered by the fast filters 71 having the shorter time constant, $\tau_f$, and the slow filters 72 having a longer time constant, $\tau_s$. The fast filters 71 generate a filtered output flow rate, $A_f$, and a filtered input flow rate, $B_f$, while the slow filters 72 generate a filtered output flow rate, $A_s$ and a filtered input flow rate, $B_s$. The filtered input flow rate is then subtracted from the filtered output flow rate for each filter 71 and 72 to compute the delta flow rates, $D_f$ and $D_s$, at 73 and 74, respectively. The difference between the filtered output flow rate and the filtered input flow rate for the slow filter 72 is also multiplied by the sensitivity constant (S) at 74 to yield the slow delta flow rate, $SD_s$. Thus, in this embodiment of the invention both the output flow rate (A) and the input flow rate (B) are filtered before the delta flow rates ($D_f$ and $SD_s$) are calculated as described above. Also as discussed above, the alarm limit (C) is really a "floating" alarm limit which is dependent upon the pitch and roll signal (P/R) from the linear accelerometers 47 and the wave roughness output ($A_r$) which can be generated by either the fast or slow filters, 71 or 72 respectively, one of the slow filters 72 in the disclosed embodiment.

Figure 8:
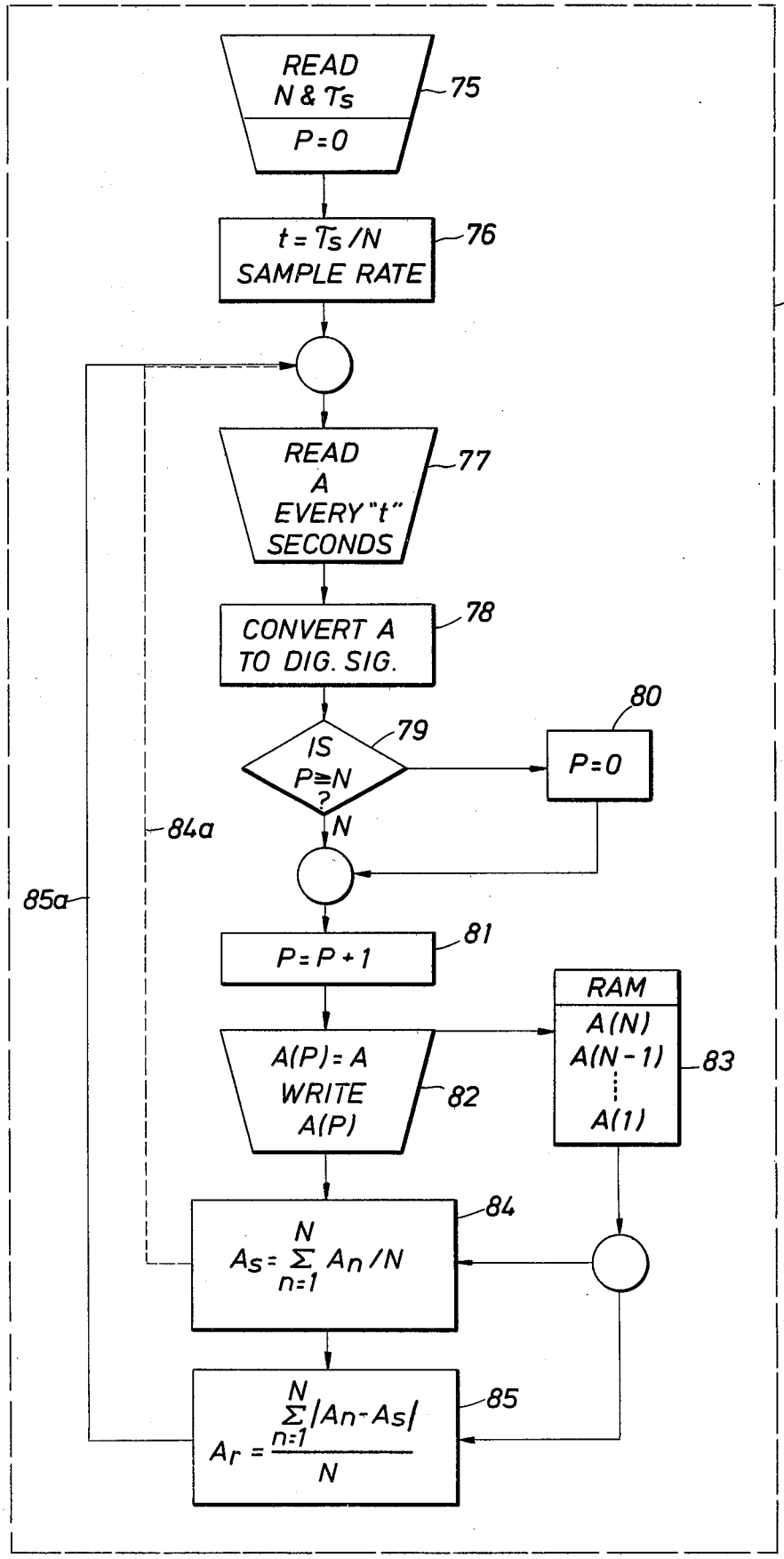
FIG. 8 is a logic flow rate of a program which functions as an active digital filter in accordance with the invention.

Because the filters, 71 and 72, operate at a cutoff frequency below 1.0 Hz, digital filtering programmed into the microcomputer 48 constitutes the preferred embodiment for attentuating the low frequency, periodic fluctuation in the output flow rate (A) that is induced by the motion of the vessel. Digital filtering, as such, is well known in the art; for a theoretical treatment see *Random Data: Analysis and Measurement Procedure* by J. S. Bendat and A. G. Piersol at pages 286–301. FIG. 8 is a logic flowchart which constitutes the slow filter 72 portion of the program in the microcomputer 48. Essentially, the filtering program computes the filtered output flow rate ($A_s$) by averaging a fixed number (N) of the most recently read output flow rates [A(N), A(N−1) . . . A(1)]. The program begins at 75 by reading the fixed number (N), which in this embodiment is equal to 128, and the time constant ($\tau_s$) of the slow filter 72, which is equal to about 60 seconds, and then initializing a counter, P, to zero. A sampling rate, t, is then computed at 76 by dividing the time constant ($\tau_s$) by the fixed number (N), whereupon the output flow rate (A) is ready every 0.50 (t) second at 77. If the output flow rate (A) is an analog signal, it must then be converted to a digital signal at 78 by an analog-to-digital subroutine which is well-known in the art. At 79 and 80 the program ensures that counter (P) does not exceed the fixed sample size (N). If the counter (P) does exceed the sample size (N), it is reset to zero; otherwise, it is incremented by one at 81. At 82, the program assigns the output flow rate (A) a position, A(P), and reads it into Random Access Memory (RAM) 83 over the oldest output flow rate (which was read 128 cycles earlier) at the corresponding position therein, A(N). Consequently, the RAM 83 contains a fixed number of readings, N=128, which is updated every cycle by throwing the oldest value out and writing in the new value. The program then reads the fixed number (N) of all the most recently read output flow rates [A(N), A(N−1) . . . A(1)] from the RAM 83 and averages them at 84 to compute the slow-filtered output flow rate ($A_s$). The fast-filtered output flow rate ($A_f$) and the filtered input flow rates ($B_f$ and $B_s$) are computed in the same fashion. The program begins another cycle after 0.50 (t) second by reading another output flow rate (A) at 77 as indicated by dotted line 84*a*. However, the program for the slow filter 72 in this case also computes the roughness output ($A_r$), the purpose of which is to lower the floating alarm limit (C) from its maximum value (50 GPM in this case) depending on the sea state as discussed hereinabove. The roughness constant ($A_r$) is computed at 85 according to the mean deviation formula wherein the differences between each output flow rate stored in the RAM 83 and the previously calculated mean ($A_s$) are summed and divided by the sample size (N). The resulting mean deviation or roughness output ($A_r$) yields a measure of the roughness of the sea. It is to be understood that other formulae could be used to measure the roughness of the sea such as, for example, the root-mean-square formula. The program then begins another cycle after 0.50 (t) second by reading another output flow rate (A) at 77 as indicated by line 85*a*.

Figure 9:
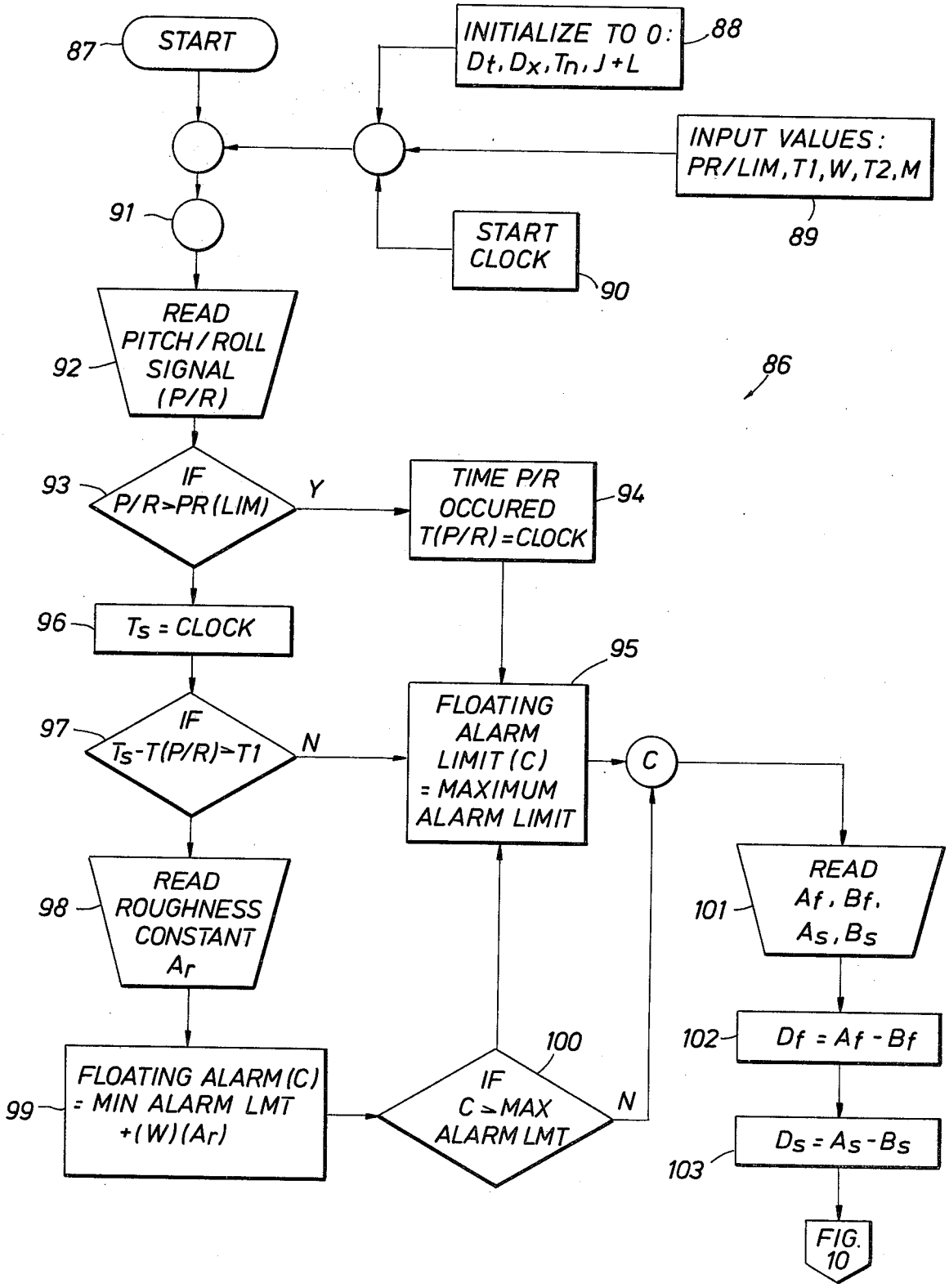
FIG. 9 is a more detailed flowchart of a portion of the program of FIG. 6 for reading the inputs from the sensors and calculating the delta flow rates ($D_f$ and $SD_s$) in accordance with the invention.
Figures 9, 10, 11:
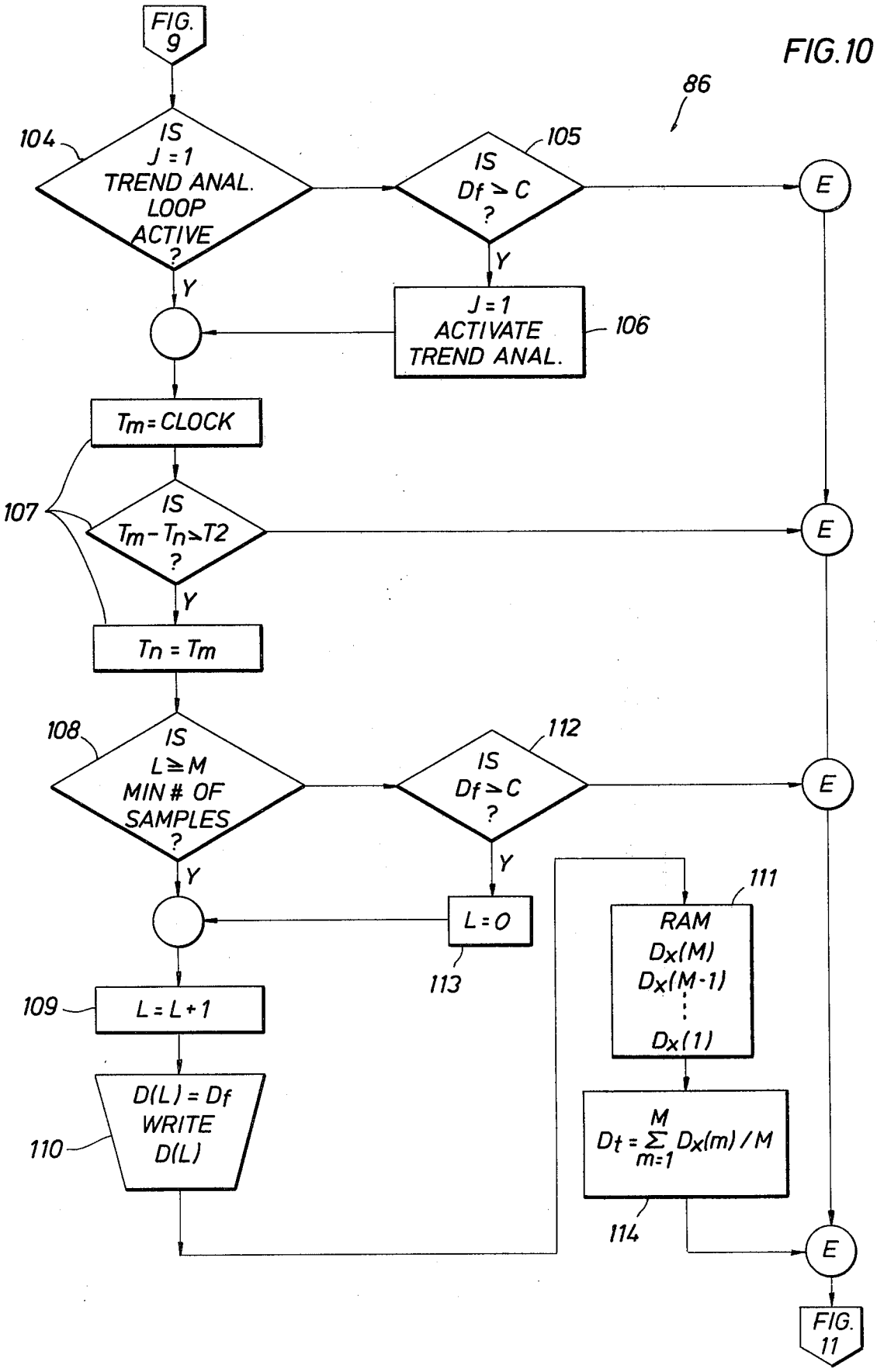
FIG. 10 is a more detailed, logic flowchart of a portion of the program of FIG. 6 for performing a trend analysis in accordance with the invention.
FIG. 11 is a more detailed, logic flowchart of a portion of the program of FIG. 6 for warning the drilling operator of a blowout or lost returns condition in accordance with the invention.
Figure 11:
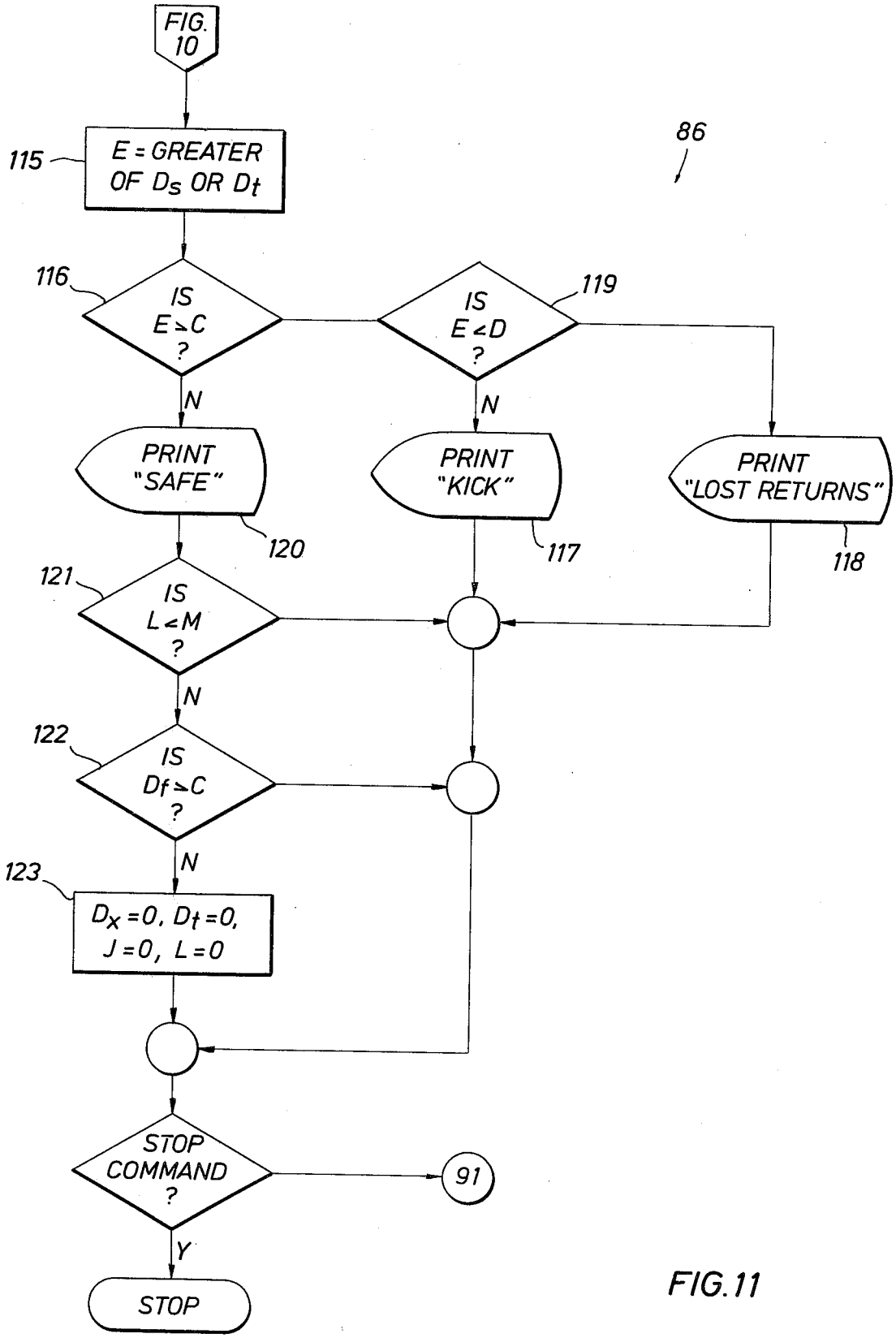

Referring in more detail to FIGS. 9, 10, and 11, a logic flowchart of the executive program is shown at 86. Referring to FIG. 9 for the start of the program at 87, variables $D_t$, $D_x$, $T_n$, J, and L are all initialized to zero at 88. Values for the constants PR/LIM, T1, W, T2, and M are then read at 89 as inputed from the keyboard 49 by the drilling operator. The delta trend value ($D_t$) and the pitch and roll limit (PR/LIM) have already been defined; the other variables and constants will be explained below and are defined as follows:

M=the number of trend analysis samples selected for the trend analysis loop;

$D_x$=an array of trend analysis samples (M) stored in RAM;

$T_n$=a time to mark the last fast delta flow rate ($D_f$) sampled for the purpose of computing a delta trend value ($D_t$);

J=a flag that indicates whether the program has begun a trend analysis;

L=a counter for the number of trend analysis samples (M);

T1=the estimated amount of time that the output flow rate (A) is affected after an excessive pitch and roll signal (P/R);

W=the scaling value selected to equate the roughness output ($A_r$) for the most severe sea state anticipated to the maximum floating alarm limit (C); and T2=the rate at which the fast delta flow rates ($D_f$) are sampled to select a delta trend value ($D_t$).

A clock is then started at 90 whereupon the microcomputer 48 proceeds into the execution loop at the connector 91.

The program then causes the microcomputer 48 to read the pitch and roll signal (P/R) provided by the linear accelerometers 47 at 92 (see also FIG. 1). As discussed above with respect to FIG. 4, the linear accelerometers 47 are mounted substantially horizontally. In this attitude they sense surge or sway accelerations and tilt angles associated with roll and pitch. Both the linear acceleration and the tilt of the conduit 37 produce fluctuations in the flow through the conduit 37. However, small angular displacements in the roll and pitch directions produce the greatest fluctuations in the output flow rate (A). Thus, when the microcomputer 48 reads an analog pitch and roll signal (P/R) at 93 which is greater than the specified pitch and roll limit (PR/LIM) corresponding to approximately one degree, the time at which the signal occurred, T(P/R), is read at 94, whereupon the floating alarm limit (C) is set to its maximum value at 95 as discussed above. However, even if the pitch and roll signals (P/R) does not exceed the pitch and roll limit (PR/LIM), the floating alarm limit (C) will still be set to its maximum value of ±50 GPM if the pitch and roll signal (P/R) exceeded the pitch and roll limit (PR/LIM) less than T1 seconds earlier, as indicated at 96 and 97. The time period, T1, takes into consideration the amount of time after an excessive pitch and roll signal (P/R) has been read that the output flow rate (A) is affected by the conduit 37 (see FIG. 4) which fills up and dumps through the output flow meter 45, as well as the inherent delay of the filters. In this case, T1 is approximately 30 seconds.

The floating alarm limit (C) is held at the maximum value during the T1 time period. However, if the T1 time period has expired, the program then reads the roughness output ($A_r$) at 98 in FIG. 9. The floating alarm limit (C) is then scaled to vary from the maximum limit when the sea is roughest to a minimum limit of approximately ±25 GPM when the sea is smooth. This is accomplished at 99 by setting the alarm limit (C) equal to the sum of the minimum limit and a floating value corresponding to a scaled roughness output ($A_r$). The floating value is equal to the product of the roughness output ($A_r$) and a scaler (W), wherein the scaler (W) is assigned a value which when multipled by the roughness output (Ar) for the most severe sea state anticipated (in the particular location where the drilling is being conducted) equals the maximum floating alarm limit. The effect of this computation controlled at 100 is to hold the floating alarm limit (C) at the maximum value during excessive pitch and roll conditions and for a time period of T1 seconds thereafter, and then allowing it to decrease to the minimum alarm limit as the sea state becomes less severe and more smooth. After the floating alarm limit (C) is calculated by the program 86 in the microcomputer 48, the filtered output and input rates ($A_f$, $A_s$, $B_f$, and $B_s$) are read at 101 whereupon the delta flow rates ($D_f$ and $SD_s$) are computed at 102 and 103 as discussed hereinabove. These rates are computed at a rate of approximately one time per second which is necessarily slower than that of the slow filter 71 taking approximately two samples per second.

Referring to FIG. 10, the program 86 now determines at 104 whether a trend analysis has already been performed. If the program 86 has not yet entered the trend analysis loop (J=0), it then determines at 105 whether the fast delta flow rate ($D_f$) has breached the floating alarm limit (C) to register a "possible" alarm ($t_1$ in FIG. 2). If the "possible" alarm has registered, the trend analysis routine is begun as indicated at 106 when J is made equal to one. The timing sequence at 107 controls how often the trend analysis samples the fast delta flow rate ($D_f$). For example, in this case the executive loop computes the fast delta flow rate ($D_f$) one time per second and T2 is set at two seconds so that every other fast delta flow rate ($D_f$) is selected for the trend analysis computation. This is accomplished by comparing the amount of time that has elapsed since the last fast delta flow rate ($D_f$) was sampled, i.e., the present time ($T_m$) less the time at which the last sample was taken ($T_n$), and comparing it to the sample rate (T2) at 107. It is to be understood that the executive loop can be timed to operate faster limited only by the speed of the filters, 71 and 72, and that the sampling rate (T2) can be set appropriately to select every other fast delta flow rate ($D_f$).

The number of trend analysis samples (M) is predetermined to establish the window size of the trend analysis. In this case the number of samples (M) is set at 15 which establishes a window size having is a 30-second period, i.e., the product of the sample rate (T2) and the number of samples (M). The program 86 controls the window size of the trend analysis by counting the number of fast delta flow rates ($D_f$) sampled (L) at 108. Since the counter (L) is initialized to zero, the counter (L) is incremented to one at 109 whereupon that particular fast delta flow rate ($D_f$) becomes the first sample, D(L)=D(1), and is written at 110 into a RAM 111 at $D_x(1)$. The array of samples stored ($D_x$) in the RAM 111 has a length equal to the number of trend analysis samples (M) wherein the oldest sample stored ($D_x$) is always replaced by the newest via the sequence of instructions at 108, 109 and 110. When the counter (L) does exceed the number of trend analysis samples (M) at 108, the trend analysis is continued for another set of M samples only if the fast delta flow rate ($D_f$) computed after the Mth stored delta flow rate, $D_x$(30), still exceeds the floating alarm limit (C) at 112 whereupon the counter (L) is reset to zero at 113 and the RAM 111 is reloaded with a second set of M samples in proper order. In any case, a delta trend ($D_t$), which is a mean deviation value as described above, is computed at 114 each time a new sample, D(L), is read into the RAM 111. After the delta trend value ($D_t$) is calculated, the program selects the greater of the slow delta flow rate ($SD_s$) or the delta trend value ($D_t$) at 115 in FIG. 11. If the greater one of the two (E) exceeds the floating alarm limit (C) at 116, a "kick" 117 or "lost returns" 118 warning is given depending on whether E is positive or negative at 119; otherwise, a "safe" signal 120 will be given to the drilling oerator. As can be seen, only the slow delta flow rate ($SD_s$) or the delta trend value ($D_t$) will trigger a warning on the video display 50 and subsequent closing of the BOP valve 33.

Figure 2:
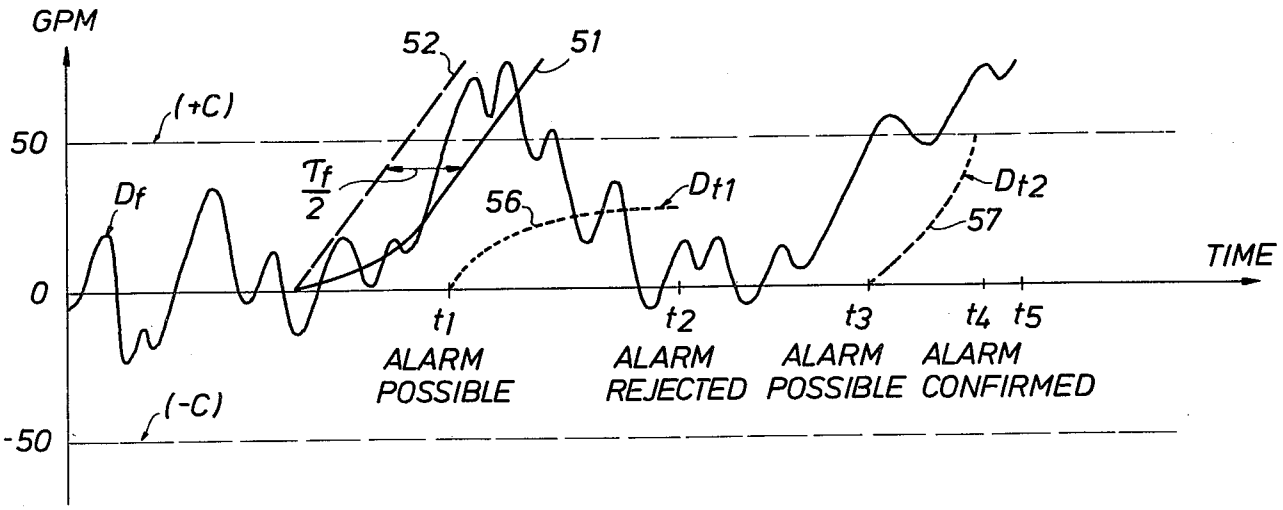
FIG. 2 is a graph illustrating the fast-filtered delta flow rate ($D_f$) as a function of time in accordance with the invention.
Figure 3:
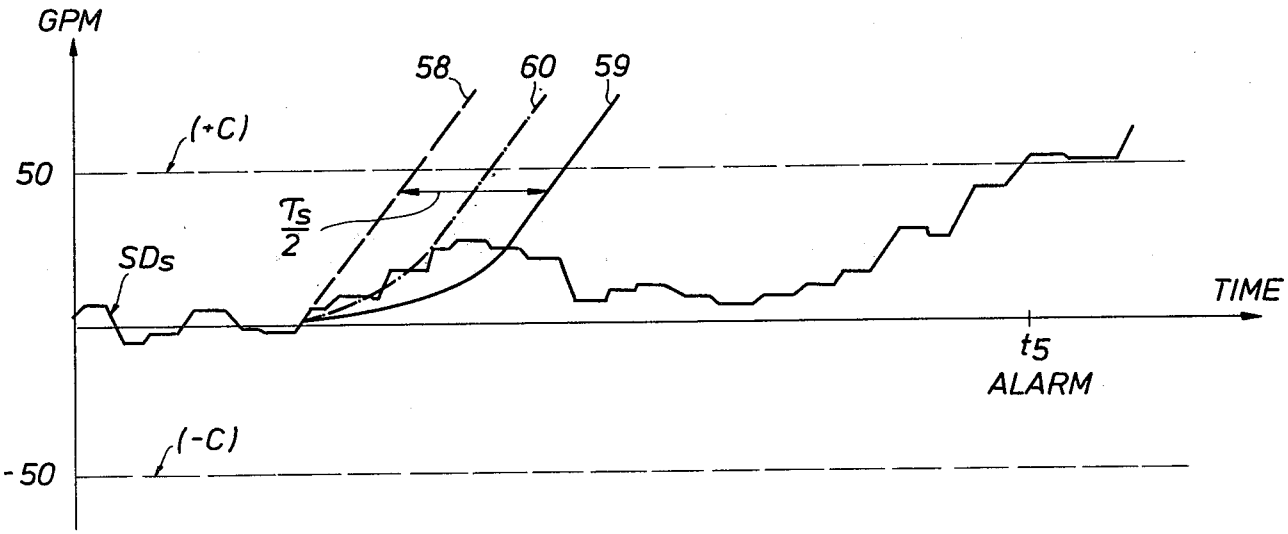
FIG. 3 is a graph illustrating the slow-filtered delta flow rate ($SD_f$) as a function of time in accordance with the invention.

To complete the analysis of the flowcharts shown in FIGS. 10 and 11, the other possible events can be explained with respect to FIGS. 2 and 3. First, if the trend analysis is not active at 104 and the fast delta flow rate ($D_f$) has not breached the floating alarm limit (C) at 105 a "safe" signal will be given by virtue of the instructions at 115, 116, and 120, after which the program 86 returns to 91 to calculate a new set of delta flow rates ($SD_s$ and $D_s$) since the counter (L) is still zero and, therefore, less than M at 121. The same sequence occurs if the trend analysis is active at 104 when the fast delta flow rate ($D_f$) is not selected as a trend analysis sample (when $T_n-T_m$ is not greater than T2) at 107, unless the slow delta flow rate ($SD_s$) exceeds the floating alarm limit (C) at 115 and 116 whereupon a "kick" 117 or "lost returns" 118 warning will be given. Secondly, if the first set of samples of the trend analysis is completed after M samples at 108 and the fast delta flow rate ($D_f$) does not exceed the floating alarm limit (C) at 112 and 122, the trend analysis will stop. As a result, the "safe" signal 120 will be given and the delta trend array ($D_x$) stored in the RAM 111, the last delta trend value ($D_t$), the trend analysis indicator (J), and the counter (L) will all be reset to zero to restart the executive loop at 91 (see curve $D_{t1}$ at 56 in FIG. 2). However, if the first set of samples of the trend analysis is completed after M samples at 108 and the fast delta flow rate ($D_f$) does exceed the floating alarm limit (C) at 112 and 122, the trend analysis will continue for a second set of M samples if the delta trend value ($D_t$) has still not breached the floating alarm limit (C) at 115 and 116. As a result, the above values are not reset to zero at 123 and the second set of samples of the trend analysis is computed. Thirdly, if the delta trend value ($D_t$) breaches the floating alarm limit (C) at 115 during any set of the trend analysis, the instruction at 116 will register a "kick" 117 or "lost returns" 118 warning (see curve $D_{t2}$ at 57 in FIG. 2).

It will be apparent that various changes may be made in details of construction and programming from those shown in the attached drawings and discussed in conjunction therewith without departing from the spirit and scope of this invention as defined in the appended claims. For example, the flowmeters may have self-contained analog-to-digital converters so that digital signals can be provided to the input parts of the microcomputer. Also, the estimated amount of time (T1) that the output flow rate (A) is effected after an excessive pitch and roll (P/R) signal depends upon the configuration and dimensions of the conduit 37. It is, therefore, to be understood that this invention is not to be limited to the specific details shown and described.

What I claim is:

1. A method for controlling the flow of drilling fluid through a subaqueous wellbore with the aid of a computer while drilling from a floating vessel, comprising the steps of:

providing the computer with a data base including at least an alarm limit (C);

continuously measuring the output flow rate (A) of the drilling fluid from the wellbore and the input flow rate (B) of the drilling fluid to the wellbore;

continuously providing the output flow rate (A) and the input flow rate (B) to the computer;

continuously filtering the output flow rate (A) in the computer to attenuate the periodic fluctuation therefrom which is due to the motion of the vessel;

repetitively calculating a delta flow rate (D) in the computer by subtracting the input flow rate (B) from the filtered output flow rate (A);

repetitively comparing in the computer the absolute value of the delta flow rate (D) to the alarm limit (C);

sampling in the computer a fixed number (M) of subsequent delta flow rates (D) when a comparison indicates that the absolute value thereof exceeds the alarm limit (C);

calculating a delta trend ($D_t$) in the computer by dividing the sum of the sampled delta flow rates (D) by the number of samples (M) each time a sample is taken;

repetitively comparing in the computer the absolute value of the delta trend ($D_t$) to the alarm limit (C); and, providing a warning that the flow of drilling fluid is out of control when a comparison indicates that the absolute value of the delta trend ($D_t$) exceeds the alarm limit (C).

2. A method as recited in claim 1, wherein the absolute value of the delta trend ($D_t$) does not exceed the alarm limit (C) after a first set of M delta flow rate (D) samples have been taken, and which comprises the additional step of sampling in the computer a second set of M delta flow rate (D) samples when a comparison indicates that the absolute value of the delta flow rate (D) still exceeds the alarm limit (C).

3. A method as recited in claims 1 or 2, which further includes the step of blocking the flow of the drilling fluid into and out from the wellbore when the delta trend ($D_t$) is positive and the step of stopping the flow of fluid and stopping drilling when the delta trend ($D_t$) is negative.

4. A method for controlling the flow of drilling fluid through a subaqueous wellbore with the aid of a computer when drilling from a floating vessel, comprising the steps of:

providing the computer with a data base including at least an alarm limit (C);

continuously measuring the output flow rate (A) of the drilling fluid from the wellbore and the input flow rate (B) of the drilling fluid to the wellbore;

continuously providing the output flow rate (A) and the input flow rate (B) to the computer;

continuously filtering the output flow rate (A) in the computer to attenuate the periodic fluctuation therefrom which is due to the motion of the vessel by use of a fast filter having a time constant from about 1.5 to 2.5 times larger than that of the periodic fluctuation connected in parallel with a slow filter having a time constant from about 3.0 to 5.0 times larger than that of the periodic fluctuation;

repetitively calculating a fast delta flow rate ($D_f$) in the computer by subtracting the input flow rate (B) from the fast-filtered output flow rate ($A_f$);

repetitively calculating a slow delta flow rate ($SD_s$) in the computer by subtracting the input flow rate (B) from the slow-filtered output flow rate ($A_s$) and multiplying the difference by a factor from about 1.5 to 3.0;

repetitively comparing in the computer the absolute value of the fast delta flow rate ($D_f$) to the alarm limit (C);

sampling in the computer a fixed number (M) of subsequent, fast delta flow rates ($D_f$) when a comparison indicates that the absolute value of the fast delta flow rate ($D_f$) exceeds the alarm limit (C);

calculating a delta trend ($D_t$) in the computer by dividing the sum of the sampled fast delta rates ($D_f$) by the number of samples (M) each time a sample is taken;

repetitively comparing in the computer the absolute value of the greater of the slow delta flow rate ($SD_s$) or the delta trend ($D_t$) to the alarm limit (C); and, providing a warning that the flow of drilling fluid is out of control when a comparison indicates that the absolute value of either the slow delta flow rate ($SD_s$) or the delta trend ($D_t$) exceeds the alarm limit (C).

5. A method as recited in claim 4, wherein the absolute value of the delta trend ($D_t$) does not exceed the alarm limit (C) after a first set of M fast delta flow rate ($D_f$) samples have been taken, which further includes the step of sampling a second set of M subsequent fast delta flow rate (D) samples if the absolute value of the fast delta flow rate ($D_f$) still exceeds the alarm limit (C).

6. A method as recited in claim 5, wherein the fast delta flow rate ($D_f$) and the slow delta flow rate ($SD_s$) is calculated at a rate no slower than one time per second and a fixed number (M) of nonsequential, subsequent, fast delta flow rates ($D_f$) are sampled.

7. A method as recited in claim 6, wherein the number of fast delta flow rate samples (M) is no less than ten.

8. A method as recited in claims 4 or 7, which further includes the step of blocking the flow of the drilling fluid into and out from the wellbore when either the slow delta flow rate ($SD_s$) or the delta trend ($D_t$) is positive and the step of stopping the flow of fluid and stopping drilling when either the slow delta flow rate ($SD_s$) or the delta trend ($D_t$) is negative.

9. A method for controlling the flow of drilling fluid through a subaqueous wellbore with the aid of a computer while drilling from a floating vessel, comprising the steps of:

providing the computer with a database including a minimum alarm limit, a maximum alarm limit, and a pitch/roll limit;

continuously measuring the output flow rate (A) of the drilling fluid from the wellbore, the input flow rate (B) of the drilling fluid to the wellbore, and at least a component of the pitch and roll (P/R) of the vessel;

continuously providing the output flow rate (A), the input flow rate (B), and the pitch and roll (P/R) signal to the computer;

continuously filtering the output flow rate (A) in the computer to attentuate the periodic fluctuation therefrom which is due to the motion of the vessel;

repetitively setting the alarm limit (C) in the computer equal to the maximum alarm limit if the pitch and roll (P/R) signal exceeds the pitch/roll limit, or equal to a roughness output ($A_r$), which varies proportionally with the roughness of the sea between the minimum and maximum alarm limit, if the pitch and roll (P/R) signal does not exceed the pitch/roll limit;

repetitively calculating a delta flow rate (D) in the computer by subtracting the input flow rate (B) from the filtered output flow rate (A);

repetitively comparing in the computer the absolute value of the delta flow rate (D) to the alarm limit (C); and, providing a warning that the flow of drilling fluid is out of control when a comparison indicates that the absolute value of the delta flow rate (D) exceeds the alarm limit (C).

10. A method as recited in claim 9, which further includes the step of blocking the flow of the drilling fluid into and out from the wellbore when the delta flow rate (D) is positive and the step of stopping the flow of fluid and stopping drilling when the delta flow rate (D) is negative.

11. A method as recited in claims 9 or 10, wherein the roughness output ($A_r$) is the mean deviation of a fixed number of the most recently measured output flow rates (A).

12. A method as recited in claims 9 or 10, wherein the roughness output ($A_r$) is the root-mean-square of a fixed number of the most recently measured output flow rates (A).

13. A method as recited in claims 9 or 10, wherein the alarm limit (C) is set to the maximum alarm limit for a period of time (T1) after the pitch and roll (P/R) signal exceeds the pitch/roll limit.

14. A method as recited in claim 13, where the period of time (T1) is no less than 30 seconds.

15. A method for controlling the flow of drilling fluid through a subaqueous wellbore with the aid of a computer while drilling from a floating vessel, comprising the steps of:

providing the computer with a data base including a minimum alarm limit, a maximum alarm limit, and a pitch/roll limit;

continuously measuring the output flow rate (A) of the drilling fluid from the wellbore, the input flow rate (B) of the drilling fluid to the wellbore, and at least a component of the pitch and roll (P/R) of the vessel;

continuously providing the output flow rate (A), the input flow rate (B), and the pitch and roll (P/R) signal to the computer;

continuously filtering the output flow rate (A) in the computer to attentuate the periodic fluctuation therefrom which is due to the motion of the vessel;

repetitively setting the alarm limit (C) in the computer equal to the maximum alarm limit if the pitch and roll (P/R) signal exceeds the pitch/roll limit, or equal to a roughness output ($A_r$) which varies proportionally with the roughness of the sea between the minimum and maximum alarm limit, if the pitch and roll (P/R) signal does not exceed the pitch/roll limit;

repetitively calculating a delta flow rate (D) in the computer by subtracting the input flow rate (B) from the filtered output flow rate (A);

repetitively comparing in the computer the absolute value of the delta flow rate (D) to the alarm limit (C);

sampling in the computer a fixed number (M) of subsequent delta flow rates (D) when a comparison indicates that the absolute value thereof exceeds the alarm limit (C);

calculating a delta trend ($D_t$) in the computer by dividing the sum of the sampled delta flow rates (D) by the number of samples (M) each time a sample is taken;

repetitively comparing in the computer the absolute value of the delta trend ($D_t$) to the alarm limit (C); and, providing a visible warning that the flow of drilling fluid is out of control when a comparison indicates that the absolute value of the delta trend ($D_t$) exceeds the alarm limit (C).

16. A method as recited in claim 15, wherein the absolute value of the delta trend ($D_t$) does not exceed the alarm limit (C) after a first set of M delta flow rate (D) samples have been taken, and which comprises the additional step of sampling in the computer a second set of M delta flow rate (D) samples when a comparison indicates that the absolute value of the delta rate (D) exceeds the alarm limit (C).

17. A method as recited in claims 15 or 16, which further includes the step of blocking the flow of the drilling fluid into and out from the wellbore when the delta trend ($D_t$) is positive and the step of stopping the flow of fluid and stopping drilling when the delta trend ($D_t$) is negative.

18. A method as recited in claim 17, wherein the roughness output ($A_r$) is the mean deviation of a fixed number of the most recently measured output flow rates (A).

19. A method as recited in claim 17, wherein the roughness output ($A_r$) is the root-mean-square of a fixed number of the most recently measured output flow rates (A).

20. A method as recited in claim 17, wherein the alarm limit (C) is set to the maximum alarm limit for a period of time (T1) after the pitch and roll (P/R) signal exceeds the pitch/roll limit.

21. A method as recited in claim 20, where the period of time (T1) is no less than 30 seconds.

22. A method for controlling the flow of drilling fluid through a subaqueous wellbore with the aid of a computer when drilling from a floating vessel, comprising the steps of:

providing the computer with a data base including a minimum alarm limit, a maximum alarm limit, and a pitch/roll limit;

continuously measuring the output flow rate (A) of the drilling fluid from the wellbore, the input flow rate (B) of the drilling fluid to the wellbore, and at least a component of the pitch and roll (P/R) of the vessel;

continuously providing the output flow rate (A) the input flow rate (B), and the pitch and roll (P/R) signal to the computer;

continuously filtering the output flow rate (A) in the computer to attentuate the periodic fluctuation therefrom which is due to the motion of the vessel by use of a fast filter having a time constant from about 1.5 to 2.5 times larger than that of the periodic fluctuation connected in parallel with a slow filter having a time constant from about 3.0 to 5.0 times larger than that of the periodic fluctuation;

repetitively setting the alarm limit (C) in the computer equal to the maximum alarm limit if the pitch and roll (P/R) signal exceeds the pitch/roll limit, or equal to a roughness output ($A_r$), which varies proportionally with the roughness of the sea between the minimum and maximum alarm limit, if the pitch and roll (P/R) signal does not exceed the pitch/roll limit;

repetitively calculating a fast delta flow rate ($D_f$) in the computer by subtracting the input flow rate (B) from the fast-filtered output flow rate ($A_f$);

repetitively calculating a slow delta flow rate ($SD_s$) in the computer by subtracting the input flow rate (B) from the slow-filtered output flow rate ($A_s$) and multiplying the difference by a factor from about 1.5 to 3.0;

repetitively comparing in the computer the absolute value of the fast delta flow rate ($D_f$) to the alarm limit (C);

sampling in the computer a fixed number (M) of subsequent, fast delta flow rates ($D_f$) when a comparison indicates that the absolute value of the fast delta flow rate ($D_f$) exceeds the alarm limit (C);

calculating a delta trend ($D_t$) in the computer by dividing the sum of the sampled fast delta rates ($D_f$) by the number of samples (M) each time a sample is taken;

repetitively comparing in the computer the absolute value of the greater of the slow delta flow rate ($SD_s$) or the delta trend ($D_t$) to the alarm limit (C); and, providing warning that the flow of drilling fluid is out of control when a comparison indicates that the absolute value of either the slow delta flow rate ($SD_s$) or the delta trend ($D_t$) exceeds the alarm limit (C).

23. A method as recited in claim 22, wherein the absolute value of the delta trend ($D_t$) does not exceed the alarm limit (C) after a first set of M fast delta flow rate ($D_f$) samples have been taken, which further includes the step of sampling a second set of M subsequent fast delta flow rate (D) samples if the absolute value of the fast delta flow rate ($D_f$) still exceeds the alarm limit (C).

24. A method as recited in claim 23, wherein the fast delta flow rate ($D_f$) and the slow delta flow rate ($SD_s$) is calculated at a rate no slower than one time per second and a fixed number (M) of nonsequential, subsequent, fast delta flow rates ($D_f$) are sampled.

25. A method as recited in claim 24, wherein the number of fast delta flow rate samples (M) is no less than ten.

26. A method as recited in claims 22 or 25, which further includes the step of blocking the flow of the drilling fluid into and out from the wellbore when either the slow delta flow rate ($SD_s$) or the delta trend ($D_t$) is positive and the step of stopping the flow of fluid and stopping drilling when either the slow delta flow rate ($SD_s$) or the delta trend ($D_t$) is negative.

27. A method as recited in claim 26, wherein the roughness output ($A_r$) is the mean deviation of a fixed number of the most recently measured output flow rates (A).

28. A method as recited in claim 26, wherein the roughness output ($A_r$) is the root-mean-square of a fixed number of the most recently measured output flow rates (A).

29. A method as recited in claim 26, wherein the alarm limit (C) is set to the maximum alarm limit for a period of time (T1) after the pitch and roll (P/R) signal exceeds the pitch/roll limit.

30. A method as recited in claim 29, where the period of time (T1) is no less than 30 seconds.

31. Apparatus for controlling the flow of drilling fluid through a subaqueous wellbore while drilling from a floating vessel, the wellbore being connected to the lower end of a drill string and the lower end of an annulus by a valve through which the drilling fluid flows, the upper end of the annulus being connected to a conduit from which the drilling fluid flows to the suction side of a pump which circulates the drilling fluid therefrom into the upper end of the drill string, through the wellbore, and back up the annulus into the conduit, said apparatus comprising:

an output flow meter connected to the exit of the conduit, said meter providing a signal corresponding to the rate of flow of drilling fluid from the wellbore (A);

an input flow meter connected between the pump and the upper end of the drill string, said meter providing a signal corresponding to the rate of flow of the drilling fluid into the wellbore (B);

computer means for reading a data base including at least an alarm limit (C) and for receiving the output flow rate (A) and the input flow rate (B) signals, said means continuously filtering the output flow rate (A) signal to attentuate the periodic fluctuation therefrom which is due to the motion of the vessel and repetitively calculating a delta flow rate (D) by subtracting the input flow rate (B) signal from the filtered output flow rate (A), repetitively comparing the absolute value of the delta flow rate (D) to the alarm limit (C) and sampling a fixed number (M) of subsequent delta flow rates (D) when a comparison indicates that the absolute value thereof exceeds the alarm limit (C), calculating a delta trend ($D_t$) by dividing the sum of the sampled delta flow rates (D) by the number of samples (M) each time a sample is taken, and then repetitively comparing the absolute value of the delta trend ($D_t$) to the alarm limit (C) to provide a warning signal when a comparison indicates that the absolute value of the delta trend ($D_t$) exceeds the alarm limit (C); and, means connected to said computer means for providing a warning that the flow of drilling fluid is out of control when a warning signal is received from said computer means.

32. Apparatus as recited in claim 31, wherein the absolute value of the delta trend ($D_t$) does not exceed the alarm limit (C) after a first set of M delta flow rate (D) samples have been taken, and said computer means samples a second set of M subsequent delta flow rate (D) samples when a comparison indicates that the absolute value of the delta flow rate (D) still exceeds the alarm limit (C).

33. Apparatus as recited in claims 31 or 32, which further comprises means connected to said computer means for actuating the valve to close off the wellbore when the delta flow rate (D) is positive and means electrically connected to said computer means for throttling back the pump to stop the circulation of fluid and for stopping drilling when the delta flow rate (D) is negative.

34. Apparatus for controlling the flow of drilling fluid through a subaqueous wellbore while drilling from a floating vessel, the wellbore being connected to the lower end of a drill string and the lower end of an annulus by a valve through which the drilling fluid flows, the upper end of the annulus being connected to a conduit from which the drilling fluid flows to the suction side of a pump which circulates the drilling fluid therefrom into the upper end of the drill string, through the wellbore, and back up the annulus into the conduit, said apparatus comprising:

an output flow meter connected to the exit of the conduit, said meter providing a signal corresponding to the rate of flow of drilling fluid from the wellbore (A);

an input flow meter connected between the pump and the upper end of the drill string, said meter providing a signal corresponding to the rate of flow of the drilling fluid into the wellbore (B);

computer means for reading a data base including at least an alarm limit (C) and for receiving the output flow rate (A) and the input flow rate (B) signals, said means continuously filtering the output flow rate (A) signal to attentuate the periodic fluctuation therefrom which is due to the motion of the vessel by using a fast filter having a time constant from about 1.5 to 2.5 times larger that that of the periodic fluctuation connected in parallel with a slow filter having a time constant from about 3.0 to 5.0 times larger than that of the periodic fluctuation, repetitively calculating a fast delta flow rate ($D_f$) by subtracting the input flow rate (B) from the fast-filtered output flow rate ($A_f$) and repetitively calculating a slow delta flow rate ($SD_s$) by subtracting the input flow rate (B) signal from the slow-filtered output flow rate ($A_s$) and multiplying the difference by a factor from about 1.5 to 3.0, repetitively comparing the absolute value of the fast delta flow rate ($D_f$) to the alarm limit (C) and sampling a fixed number (M) of subsequent fast delta flow rates ($D_f$) when a comparison indicates that the absolute value thereof exceeds the alarm limit (C), calculating a delta trend ($D_t$) by dividing the sum of the sampled fast delta flow rates ($D_f$) by the number of samples (M) each time a sample is taken, and then repetitively comparing the absolute value of the greater of the slow delta flow rate ($SD_s$) or the delta trend ($D_t$) to the alarm limit (C) to provide a warning signal when a comparison indicates that the absolute value of either the slow delta flow rate ($SD_s$) or the delta trend ($D_t$) exceeds the alarm limit (C); and, means connected to said computer means for providing a warning that the flow of drilling fluid is out of control when a warning signal is received from said computer means.

35. Apparatus for controlling the flow of drilling fluid through a subaqueous wellbore while drilling from a floating vessel, the wellbore being connected to the lower end of a drill string and the lower end of an annulus by a valve through which the driling fluid flows, the upper end of the annulus being connected to a conduit from which the drilling fluid flows to the suction side of a pump which circulates the drilling fluid therefrom into the upper end of the drill string, through the wellbore, and back up the annulus into the conduit, said apparatus comprising:

an output flow meter connected to the exit of the conduit, said meter providing a signal corresponding to the rate of flow of drilling fluid from the wellbore (A);

an input flow meter connected between the pump and the upper end of the drill string, said meter providing a signal corresponding to the rate of flow of the drilling fluid into the wellbore (B);

a pair of accelerometers mounted on the vessel, said accelerometers providing a signal corresponding to at least a component of the pitch and roll (P/R) of the vessel;

computer means for reading a data base including a minimum alarm limit, a maximum alarm limit and a pitch/roll limit and for receiving the output flow rate (A) signal, the input flow rate (B) signal, and the pitch and roll (P/R) signal, said means continuously filtering the output flow rate (A) signal to attentuate the periodic fluctuation therefrom which is due to the motion of the vessel by using a fast filter having a time constant from about 1.5 to 2.5 times larger that that of the periodic fluctuation connected in parallel with a slow filter having a time constant from about 3.0 to 5.0 times larger than that of the periodic fluctuation, repetitively calculating a fast delta flow rate ($D_f$) by subtracting the input flow rate (B) from the fast-filtered output flow rate ($A_f$) and repetitively calculating a slow delta flow rate ($SD_s$) by subtracting the input flow rate (B) signal from the slow-filtered output flow rate ($A_s$) and multiplying the difference by a factor from about 1.5 to 3.0, repetitively setting the alarm limit (C) equal to the maximum alarm limit if the pitch and roll (P/R) signal exceeds the pitch/roll limit or equal to a roughness output ($A_r$), which varies proportionally with the roughness of the sea between the minimum and maximum alarm limit, if the pitch and roll (P/R) signal does not exceed the pitch/roll limit, repetitively comparing the absolute value of the fast delta flow rate ($D_f$) to the alarm limit (C) and sampling a fixed number (M) of subsequent fast delta flow rates ($D_f$) when a comparison indicates that the absolute value thereof exceeds the alarm limit (C), calculating a delta trend ($D_t$) by dividing the sum of the sampled fast delta flow rates ($D_f$) by the number of samples (M) each time a sample is taken, and then repetitively comparing the absolute value of the greater of the slow delta flow rate ($SD_s$) or the delta trend ($D_t$) to the alarm limit (C) to provide a warning signal when a comparison indicates that the absolute value of either the slow delta flow rate ($SD_s$) or the delta trend ($D_t$) exceeds the alarm limit (C); and, means connected to said computer means for providing a warning that the flow of drilling fluid is out of control when a warning signal is received from said computer means.

36. Apparatus as recited in claims 34 and 35, which further comprises means electrically connected to said computer means for actuating the valve to close off the wellbore when either the slow delta flow rate ($SD_s$) or the delta trend ($D_t$) is positive and means electrically connected to said computer means for throttling back the pump to stop the circulation of fluid and for stopping drilling when the slow delta flow rate ($SD_s$) or the delta trend ($D_t$) is negative.

37. Apparatus as recited in claim 36, wherein the roughness output ($A_r$) is the mean deviation of a fixed number of the most recently measured output flow rates (A).

38. Apparatus as recited in claim 36, wherein the roughness output ($A_r$) is the root-mean-square of a fixed number of the most recently measured output flow rates (A).

39. Apparatus as recited in claim 36, wherein the alarm limit (C) is set to the maximum alarm limit for a period of time (T1) no less than 30 seconds after the pitch and roll (P/R) signal exceeds the pitch/roll limit.

40. Apparatus as recited in claim 36, wherein the absolute value of the delta trend ($D_t$) does not exceed the alarm limit (C) after a first set of M fast delta flow rate ($D_f$) samples have been taken, and said computer means samples a second set of M subsequent fast delta flow rate ($D_f$) samples when a comparison indicates that the absolute value of the fast delta flow rate ($D_f$) still exceeds the alarm limit (C).

41. Apparatus as recited in claim 36, wherein said computer means calculates the fast delta flow rate ($D_f$) and the slow delta flow rate ($SD_s$) at a rate no slower than one time per second and samples a fixed number (M) of nonsequential, subsequent, fast delta flow rates ($D_f$).

42. A method for controlling the flow of drilling fluid through a subaqueous wellbore while drilling from a floating vessel, comprising the steps of:

measuring the output flow rate (A) of the drilling fluid from the wellbore and the input flow rate (B) of the drilling fluid to the wellbore;

calculating in a computer a delta flow rate (D) by subtracting the input flow rate (B) from the output flow rate (A);

comparing in a computer the absolute value of the delta flow rate (D) with an alarm limit (C) so as to generate a warning indicating that the flow of drilling fluid is out of control when the comparison indicates that the absolute value of the delta flow rate (D) exceeds the alarm limit (C); and filtering in the computer the value of at least one of the parameters (A) and (D) to reduce or minimize the effect of the vessel's motion on the generation of said warning;

wherein at least a component of the pitch and roll (P/R) of the vessel is measured and the alarm limit (C) is set equal to a maximum alarm limit if the pitch and roll (P/R) measured value exceeds a pitch/roll limit, or equal to a roughness output ($A_r$) which varies proportionally with the roughness of the sea between a minimum alarm limit and the maximum alarm limit if the pitch and roll (P/R) measured value does not exceed the pitch/roll limit.

43. Apparatus for controlling the flow of drilling fluid through a subaqueous wellbore while drilling from a floating vessel, comprising:

an output flow measuring means and an input flow measuring means, arranged respectively to measure the output flow rate (A) of the drilling fluid from the wellbore and the input flow rate (B) of the drilling fluid to the wellbore;

computer means arranged to calculate a delta flow rate (D) by subtracting the input flow rate (B) from the output flow rate (A) and to compare the absolute value of the delta flow rate (D) with an alarm limit (C) so as to generate a warning indicating that the flow of drillin fluid is out of control when the comparison indicates that the absolute value of the delta flow rate (D) exceeds the alarm limit (C);

means for measuring at least a component of the pitch and roll (P/R) of the vessel; and filter means arranged to modify the value of at least one of the parameters (A) and (D) in accordance with the motion of the floating vessel caused by the action of the sea so as to reduce or minimize the effect of the vessel's motion on the generation of said warning, said filter means being arranged to set the alarm limit (C) equal to a maximum alarm limit if the pitch and roll (P/R) measured value exceeds a pitch/roll limit, or equal to a roughness output ($A_r$) which varies proportionally with the roughness of the sea.

* * * * *